US012768060B2

(12) United States Patent
Spinetti et al.

(10) Patent No.: US 12,768,060 B2
(45) Date of Patent: Oct. 20, 2026

(54) CATHODE CURRENT COLLECTOR BAR OF AN ALUMINIUM PRODUCTION CELL

(71) Applicants: Novalum SA, Sion (CH); Tokai COBEX GmbH, Wiesbaden (DE)

(72) Inventors: Gualtiero Spinetti, Salò (IT); René Von Kaenel, Venthône (CH); Markus Pfeffer, Affing (DE); Oscar Vera Garcia, Munich (DE); Mariusz Minkina, Raciborz (PL); Seweryn Mielnik, Cyprzanow (PL)

(73) Assignees: NOVALUM SA, Sion (CH); Tokai COBEX GmbH, Wiesbaden (DE)

( * ) Notice: Subject to any disclaimer, the term of this patent is extended or adjusted under 35 U.S.C. 154(b) by 565 days.

(21) Appl. No.: 18/558,635

(22) PCT Filed: Jan. 24, 2022

(86) PCT No.: PCT/IB2022/050595
§ 371 (c)(1),
(2) Date: Nov. 2, 2023

(87) PCT Pub. No.: WO2022/238763
PCT Pub. Date: Nov. 17, 2022

(65) Prior Publication Data

US 2024/0240342 A1 Jul. 18, 2024

(30) Foreign Application Priority Data

May 10, 2021 (CH) ..... 00522/21

(51) Int. Cl.
*C25C 3/16* (2006.01)
*C25C 3/08* (2006.01)
*C25C 7/02* (2006.01)

(52) U.S. Cl.
CPC ..... *C25C 3/16* (2013.01); *C25C 3/08* (2013.01); *C25C 7/02* (2013.01)

(58) Field of Classification Search
CPC ..... C25C 3/16
See application file for complete search history.

(56) References Cited

U.S. PATENT DOCUMENTS 3,551,319 A 12/1970 Elliott
5,976,333 A 11/1999 Pate
(Continued)

FOREIGN PATENT DOCUMENTS

JP 2017534770 A 11/2017
RU 2348743 C2 3/2009
(Continued)

OTHER PUBLICATIONS

Office Action issued on Apr. 17, 2026, in corresponding Chinese Application No. 202280010970.2, 15 pages.
(Continued)

*Primary Examiner* — Brian W Cohen
(74) *Attorney, Agent, or Firm* — Maier & Maier, PLLC

(57) ABSTRACT

An aluminium production cell includes an elongated cathode current collector bar in contact with a carbonaceous cathode, the cathode current collector bar of copper or a copper alloy coated on its surface facing the cathode or all around with a thin steel protective layer 0.15 mm to 4 mm thick that forms an effective protection of the current collector bar from diffusion of aluminium or other reaction products produced on the carbonaceous cathode during operation. The volume ratio of the copper or copper alloy to the thin steel protective layer is for example in a range 400%-500%. The protective thin steel layer including an optional pre-applied thinner conductive non-ferrous under or overcoat is preferably in
(Continued)

direct contact with the carbonaceous cathode that is ready to use with no need for rodding with cast iron.

13 Claims, 4 Drawing Sheets

(56) References Cited

U.S. PATENT DOCUMENTS

| | | | |
|---|---|---|---|
| 6,231,745 | B1 | 5/2001 | Homley et al. |
| 11,136,682 | B2 | 10/2021 | Von Kaenel et al. |
| 2003/0173214 | A1 | 9/2003 | Juric et al. |
| 2005/0218006 | A1 | 10/2005 | Bonnafous et al. |
| 2010/0258434 | A1 | 10/2010 | Bayer et al. |
| 2017/0321338 | A1 | 11/2017 | Von Kaenel et al. |

FOREIGN PATENT DOCUMENTS

| | | | |
|---|---|---|---|
| RU | 2494174 | C2 | 9/2013 |
| RU | 2657682 | C2 | 6/2018 |
| WO | 01/63014 | A1 | 8/2001 |
| WO | 2016/007905 | A1 | 1/2016 |
| WO | 2018/019888 | A1 | 2/2018 |
| WO | 2018/019910 | A1 | 2/2018 |

OTHER PUBLICATIONS

International Search Report issued on May 23, 2022, in corresponding International Application No. PCT/IB2022/050595, 8 pages.
International Preliminary Report on Patentability issued on Nov. 21, 2022, in corresponding International Application No. PCT/IB2022/050595, 6 pages.
Office Action issued on Dec. 2, 2025, in corresponding Japanese Application No. 2023-569787, 6 pages.
Office Action and Search Report issued on May 28, 2025, in corresponding Russian Application No. 2023132012, 19 pages.

CATHODE CURRENT COLLECTOR BAR OF AN ALUMINIUM PRODUCTION CELL

FIELD

The invention relates to the production of Aluminium and relates in particular to a cathode current collector bar in contact with a carbonaceous cathode of a Hall-Héroult Aluminium production cell.

BACKGROUND

Aluminium is produced by the Hall-Héroult process, by electrolysis of alumina dissolved in cryolite based electrolytes at temperature up to 1000° C. A typical Hall-Héroult cell is composed of a steel shell, an insulating lining of refractory materials and a carbon cathode holding the liquid metal. The cathode is composed of a number of cathode blocks in which collector bars are embedded at their bottom to extract the current flowing through the cell.

WO 01/63014 describes a collector bar construction for use in a Hall-Héroult electric reduction cell to produce Aluminium. Each collector bar includes a core of relatively high electrical conductivity material (copper or a copper alloy) and an outer housing of a more chemically resistant material than the core material, typically of steel. Preferably the collector bar is cylindrical, with the diameter of the core being 60-80%, preferably 70%, of the diameter of the collector bar. This means the diameter and hence the thickness of the steel housing is at least 20% of the diameter of the copper or copper alloy core. In the given example, a 70 mm diameter copper rod is fitted into a steel tube 100 mm outer diameter and 70 mm inner diameter, ie. the steel tube has a wall thickness of 15 mm. This corresponds to a relative volume of copper to steel of 96% or steel to copper of 104%.

Each collector bar includes a section that is cast or glued in a channel of the cathode block. This typically involves rodding the end surface that fits against the cathode and its side surfaces with cast iron when the cell is put into service.

US 2010/00258434 provides a composite conductor bar of simpler construction than that of WO2001/063014, with a massive body of lower conductivity (steel) that is bonded to and supports a smaller body of greater conductivity (copper) that contacts the carbon cathode, and where the relative cross-sectional areas of the two conductors of the composite collector bar optimize electrical current and heat flux through the composite.

SUMMARY

An object of the invention is to provide a cathode current collector assembly for a Hall-Héroult Aluminium production cell, the assembly comprising an elongated current collector bar made of highly electrically conductive copper or a copper alloy coated on its surface facing the cathode or all around with a protective layer that is more mechanically and chemically resistant than the copper or copper alloy, which assembly:

- is advantageously ready-to-use in that it does not necessarily require rodding with cast iron or glue or ramming paste to prepare it for service, whence its name Ready-to-Use Cathode or RuC;
- is not subject to deleterious effects of the diffusion of Aluminium and other products produced in operation of the cell into the underlying copper or copper alloy of the current collector bar, such that the cell is able to operate for long periods without Aluminium and other products produced in operation of the cell unwantedly reacting with the underlying copper or a copper alloy;
- at the end of the useful life of the cell when it is dismantled, allows ready recuperation of the copper or copper alloy such that practically the entire quantity of copper or copper alloy making up the assembly can be recuperated; and
- can be significantly smaller in size allowing cell design modifications leading to longer cell life and/or lower production cost.

The invention relates to an Aluminium production cell comprising an elongated cathode current collector bar in contact with a carbonaceous cathode, of the type where the elongated cathode current collector is made of highly electrically conductive copper or a copper alloy is coated on its surface facing the cathode or all around with a thin steel protective layer that is more mechanically and chemically resistant than the copper or copper alloy.

According to the invention, the thickness of the thin protective steel layer corresponds to a minimum thickness of the layer that is sufficient to form an effective diffusion barrier to protect the copper or copper alloy of the current collector bar from diffusion of reaction products produced on the carbonaceous cathode during operation, wherein:

- the volume ratio of the copper or copper alloy to the thin steel protective layer is at least 200% and preferably at least 300% or more preferably at least 400%, for example in a range 300%-950% or 400%-500%, compared to the preferred volume ratio of 96% with regard to the steel tube only, or only 57% when considering also the additional steel sleeve that surrounds the copper tube at its end, as shown in FIG. 6 of WO 01/63014;
- the protective thin steel layer has a thickness of 0.15 mm up to 4 mm; and
- the protective thin steel layer is in direct or indirect contact with the carbonaceous cathode and is self-supporting, preferably with no glue or cast iron needed to hold it in place, which obviates the need for wider slots and cladded bars fixed with ramming paste, cast iron or glue.

Preferably, the protective thin steel layer or an optional pre-applied thinner conductive non-ferrous under or overcoat on the protective steel layer is in direct contact with walls of a slot in the carbonaceous cathode.

Alternatively, but less preferred, the protective thin steel layer—possibly including an optional pre-applied thinner conductive non-ferrous under or overcoat—is in contact with the carbonaceous cathode through a conductive layer of ramming paste, cast iron or glue.

The protective thin steel layer can be made of standard steel or alloy steel. Standard steel is an alloy of iron with typically a few tenths of a percent of carbon to improve its strength compared to iron. Alloy steels are made of iron, carbon and other elements such as vanadium, silicon, nickel, manganese, copper and chromium. Preferably the protective thin layer is made of low-carbon steel, chromium-based steel, nickel-based steel or chromium-nickel based steel. Other examples are low carbon manganese based steels with various impurities.

In preferred embodiments, the thickness of the protective thin steel layer is preferably from 1.5 mm to 3 mm. The volume ratio between the conductive copper or copper alloy and the protective thin steel layer is higher than 200% and preferably higher than 300% or more preferably higher than 400%, for example in the range 300%-950% or 400%-500%.

The cathode collector bars of the RuC cathode, with the thin steel protective layer on a copper or copper alloy core or bar, can be produced by hot or cold extrusion processes, hot or cold rolling processes, hot or cold drawing processes, hot or cold hammering processes, wrapping and/or welding processes and shrink fitting process.

One example of this production process is that the cathode collector bar can have a cylindrical core of copper or copper alloy bar and the protective thin steel layer can be a tube that is pressed against the copper or copper alloy bar in such a way that the copper or copper alloy core is in full contact with the protective layer to achieve a homogeneous pressure of the cathode current collector bar towards the carbon cathode once in operation.

Initially there can be a gap between the copper or copper alloy and the protective thin steel layer, which gap is smaller than the thermal expansion of the copper or copper alloy, to achieve a contact pressure between the copper or copper alloy and the protective thin steel layer and as well between the protective thin steel layer and the carbon cathode.

In another embodiment, the copper or copper alloy is in the form of a bar of rectangular or square cross-section that is protected on one side facing the cathode with the protective thin steel layer.

In some embodiments, the protective thin steel layer is coated with an additional top layer and/or under layer of copper, nickel and/or chromium and/or a graphite paint or foil layer wherein the additional top layer and/or underlayer preferably has a thickness of from 1 μm to 1 mm. The copper, nickel and chromium layers can be electrodeposited or otherwise applied.

When the copper or copper alloy is in the form of a rectangular bar, the protective thin steel layer is coated on all sides of the rectangular bar, or on one side of the rectangular bar and, from adjacent to the coated side, at least partly along the two other sides of the rectangular bar.

In the cell according to the invention, the external end of the collector bar of copper or copper alloy is connected to the external current bus preferably by a massive steel bar as described in WO 2016/07905 and U.S. Pat. No. 11,136,682. Alternative connections to the external current bus are described in WO 2018/019888 and WO 2018/019910.

Also, in the cell according to the invention, the collector bar of copper or copper alloy with a thin protective steel layer is normally disposed horizontally as in conventional cells, but in a variation the collector bar could include an inclined part as described in WO 2018/019910 to consolidate the feature that the cell does not require rodding with cast iron.

DETAILED DESCRIPTION

Figure 1:
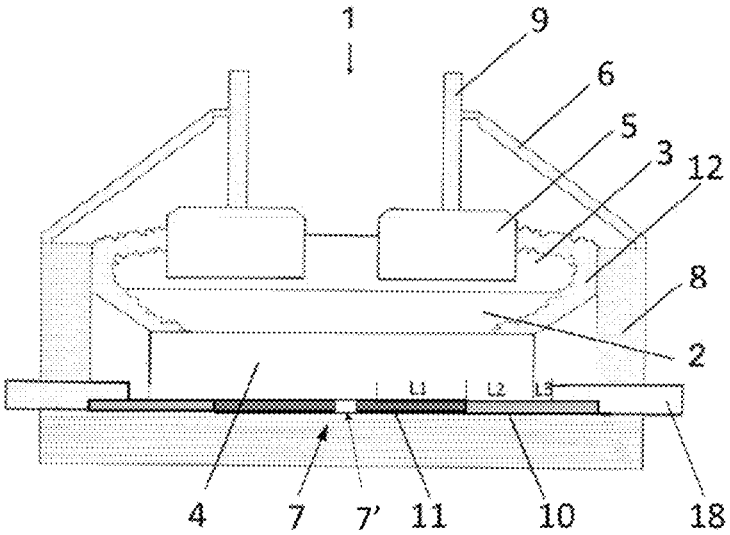
FIG. 1 is a schematic cross-section through a Hall-Héroult cell equipped with a collector bar according to the invention.

FIG. 1 schematically shows a Hall-Héroult Aluminium-production cell 1 comprising a carbon cathode cell bottom 4, a pool 2 of liquid cathodic Aluminium on the carbon cathode cell bottom 4, a fluoride—i.e. cryolite-based molten electrolyte 3, containing dissolved alumina on top of the Aluminium pool 2, and a plurality of anodes 5 suspended in the electrolyte 3. Also shown is the cell cover 6, cathode current collector bars 7 according to the invention that lead into the carbon cell bottom 4 from outside the cell container 8 and anode suspension rods 9. As can be seen, the collector bar 7 is divided in zones. Zone 10 is insulated electrically and zone 11 a central zone where the collector bar 7 is under the central part of the cell. Molten electrolyte 3 is contained in a crust 12 of frozen electrolyte. Massive steel bars 18 connected in electrical series to the ends of the collector bars 7 protrude outside the cell 1 for connection to external current supplies. As shown in FIG. 1, the massive steel bars 18 are located outside the cathode 4, but alternatively the inner ends of the massive steel bars 18 could possibly penetrate by a small distance inside the cathode 4.

As illustrated, the collector bar 7 can be split in its center to leave a gap 7' mainly to compensate for thermal expansion, but such a gap is not essential.

Zone 10 of the collector bar is for example insulated by being wrapped in a sheet of alumina or by being encased in electrically insulating ceramic material or simply electrically insulating material.

The collector bar 7 is made of a copper or copper alloy core or bar with a thin protective steel layer that can be applied along its entire length for manufacturing convenience. However, this thin protective steel layer is not required in the insulated zone 10 but is essential in the central zone 11 where it contacts the carbon cathode for transfer of electric current and protects the copper or copper alloy.

Figure 2:
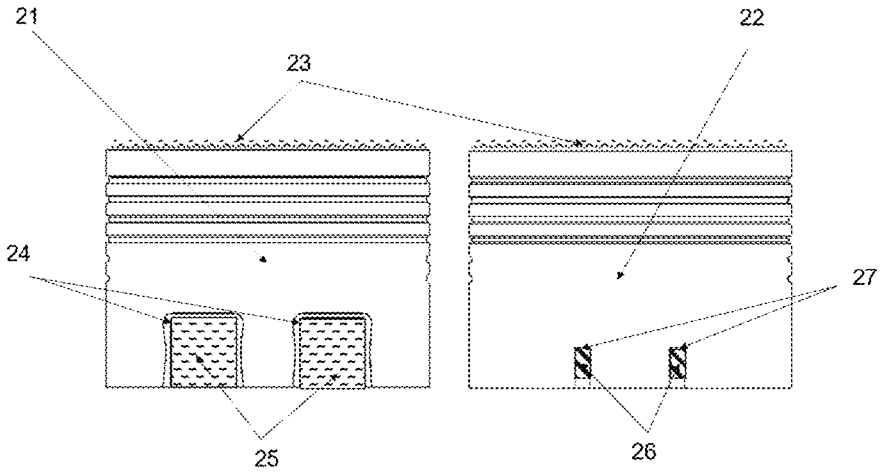
FIG. 2 is a schematic vertical section through a cell cathode, on the left is a conventional carbon cathode and on the right is a carbon cathode fitted with copper bars protected with a thin steel layer according to the invention.

FIG. 2 is a schematic vertical section through a cell cathode. On the left is a conventional carbon cathode 21 using steel bars 25 rodded with cast iron 24. On the right is a carbon cathode 22 fitted with copper bars 26 protected with a thin protective steel layer 27 according to the invention, called the RuC cathode for "Ready-to-use Cathode". As can be seen, the copper bars 26 are of rectangular cross-section and their sides with the thin protective steel layer 27 fit directly in contact with the facing walls of a rectangular groove in the carbon cathode 22 with no interposed cast iron.

The RuC cathode uses a thin protective steel layer on the copper bars and differs from the conventional carbon cathode from many points of view:

a) The importance of the protective barrier was demonstrated by testing a copper core in direct contact copper to carbon without a protective layer. Due to the open pores structure of the carbon cathodes 21,22, the liquid bath layer 23 existing under the liquid metal in the cell diffuses down to the carbon collector bar interface. In the case of a conventional cathode, the interface is cast iron 24 and the massive conductor bars 25 are made of steel. In the case of the RuC cathode, the interface is a thin protective steel layer 27. At the interface, many chemical reactions involving liquid Na3AlF6, AlF3, NaF, MgF2, and other species produce liquid Aluminium (Reference: Aluminium Smelter Technology, K. Grjotheim and B. Welch ISBN 3-37017-162-6, Aluminium Verlag pp 119-124). One of the known chemical reactions is the following: 3Na(gas)+AlF3 (solid)->Al(liquid)+3NaF(solid).

Figure 3:
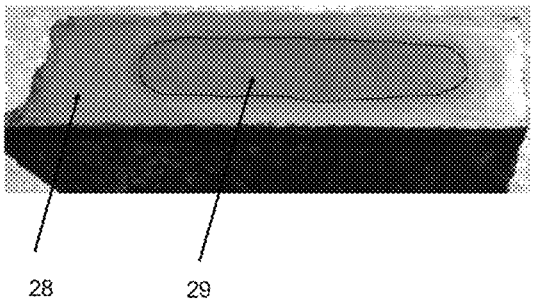
FIG. 3 is a photograph showing yellow Aluminium bronze observed after extended use without the more mechanically and chemically resistant thin steel layer.

Without the thin protective steel layer, the liquid Aluminium formed at the copper bar surface would diffuse in the copper to form solid Aluminium bronze alloy. FIG. 3 is a photograph showing yellow Aluminium bronze observed on a copper bar without a protective layer after having performed a cell autopsy 450 days after cell startup. The yellow Aluminium bronze 28 and the pure copper 29 are shown for a sample of section 70×25 mm.

b) As can be observed in Table 01, which concerns a copper bar without any protective layer, the diffusion depth after 450 days is important ranging from 5 mm to 15 mm and even deeper. The content of other metallic elements can also be significant. Table 01 shows Al and Si contents as function of the distance to the copper bar surface after 450 days operation for 10 samples taken around the copper bar:

TABLE 01

Aluminium and Silicium weight in %

Figure 4:
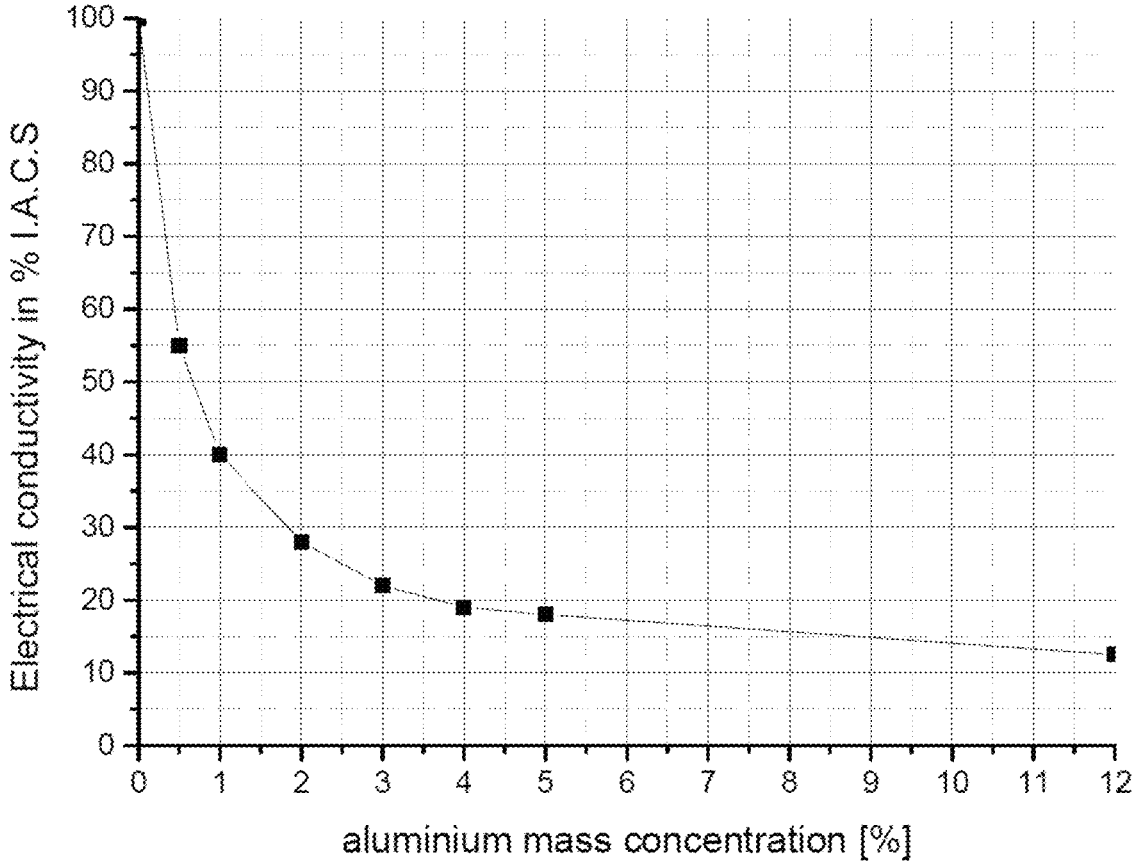
FIG. 4 shows the relative electrical conductivity of diffused copper by Aluminium with respect to the conductivity of pure copper as function of the Aluminium concentration in the copper.
Figure 5:
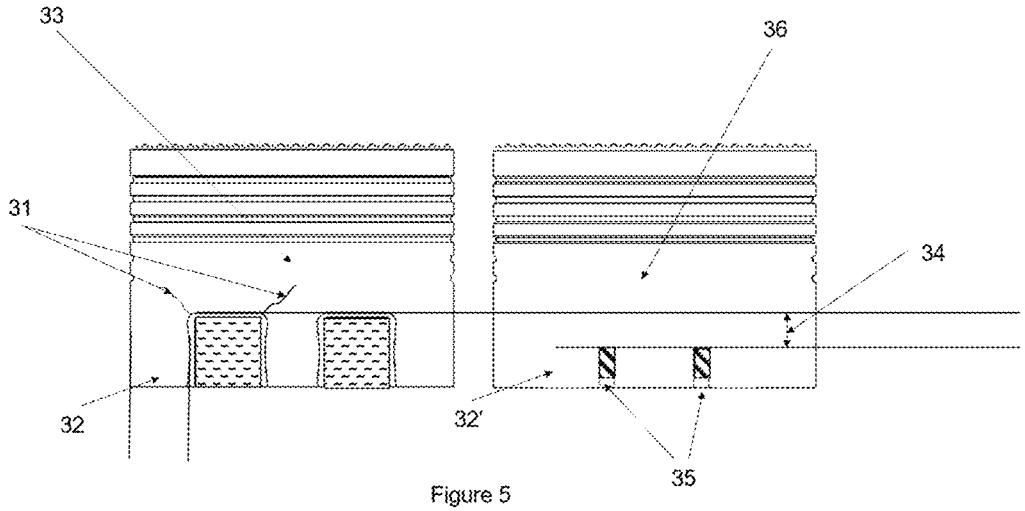
FIG. 5 is a schematic illustration of two cathodes that illustrates the saving of carbon height above the current collector bar, leading to longer cell life.

| | Measurements at 5 mm | | Measurements at 10 mm | | Measurements at 15 mm | |
|---|---|---|---|---|---|---|
| Sample | Al | Si | Al | Si | Al | Si |
| 1 | 0.50 | 0.65 | 0.21 | 0.14 | 0.58 | 0.06 |
| 2 | 0.52 | 0.64 | 0.20 | 0.36 | 0.33 | 0.03 |
| 3 | | 0.56 | 0.41 | 0.21 | 0.33 | 0.05 |
| 4 | 2.33 | 0.38 | 0.71 | 0.28 | 0.53 | 0.05 |
| 5 | 0.44 | 0.01 | 0.43 | 0.01 | 0.43 | 0.02 |
| 6 | 3.59 | 0.48 | 2.41 | 0.64 | 1.23 | 0.39 |
| 7 | 5.30 | 0.59 | 3.84 | 0.51 | 2.47 | 0.48 |
| 8 | 4.91 | 0.40 | 5.13 | 0.44 | 4.31 | 0.28 |
| 9 | 2.87 | 0.04 | 1.06 | 0.01 | 0.51 | 0.03 |
| 10 | 0.38 | 0.01 | 0.35 | 0.01 | 0.25 | 0.01 |
| 11 | 5.39 | 0.46 | 3.66 | 0.50 | 2.38 | 0.54 |
| 12 | 2.21 | 0.34 | 0.93 | 0.44 | 0.27 | 0.27 |

c) FIG. 4 shows the relative electrical conductivity with respect to the conductivity of pure copper as function of the % of the content of other metals, as by diffusion, in particular diffused Aluminium. The abbreviation "% I. A. C. S" in FIG. 4 means the electrical conductivity of copper, depending on the alloyed Aluminium concentration, relative to the International Annealed Copper Standard having 100% electrical conductivity. The electrical conductivity of copper significantly decreases with the concentration of metallic elements in particular Aluminium. This is obviously not desired as one of the important roles of the copper bar is to decrease the cathode electrical resistance.

d) An advantage of using the RuC cathode in comparison to a conventional carbon cathode solution 31 is also the saving of carbon height 34 above the bar 30 leading to longer cell life that can range from one year to many years depending on the technology. This height may range from 5 mm to 150 mm. This is illustrated in FIG. 5. As can be seen, like in FIG. 2, the copper bars are of rectangular cross-section and their sides with the thin protective steel layer fit directly in contact with the facing walls of a rectangular groove in the carbon cathode 36 with no interposed cast iron. When the copper bar is as shown received in an open-ended slot in the cathode block 36, in opposition to a round or closed hole, the open end of the copper bar can be protected by carbonaceous material, concrete or refractory material 35.

c) Wings cracks 31 may occur in conventional carbon cathodes 33 when the side wing thickness 32 is too small. The solution of using copper bars prevents wings cracks thanks to the small dimensions of the bars and precise machining. Indeed, steel and cast iron of massive steel cathodes expand thermally more than the carbon blocks and this leads to mechanical stresses that may crack the carbon cathode. Copper expands more than the carbon cathode, but for the RuC cathode 36 the small dimensions of the copper bars lead to wide carbon wings 32' that are not affected mechanically. Moreover, precise machining of the grooves in the carbon cathode 36 achieves the exact contact pressure at the interface that is 2 MPa to 12 MPa to achieve a low contact electrical resistance. Such a pressure reduces the electrical contact resistance by a factor 2 to 10 when compared to the conventional carbon cathode and prevents any cracking. The conventional rodding process used for cathode 33 consists in preheating the cathodes, casting the cast-iron at around 1500° C. which solidifies and shrinks at room temperature before being heated again in the cell at the operating temperature around 900° C. The rodding process does not allow for good and precise electrical contacts.

f) The thin steel barrier prevents the diffusion of metals in the copper and by that avoids any volume increase of the bars that could change the local stresses and eventually lead to wing cracks even with the copper bars and/or avoids any eutectic alloy decreasing the melting temperature.

g) When using the conventional carbon cathodes, some technologies are now using copper inserts inside the steel bars according to WO 2001/063014. However, costly procedures are required to remove or separate the copper core or insert from the distorted steel collector bars at the end-of-life cycle, making the copper recovery uneconomical. The main reason for this is the diffusion welding of Cu into steel and Fe into Cu and the too high weight ratio of distorted steel to copper that makes it not recyclable as such. The thin thickness of the protective thin steel layer of the copper bars of the inventive RuC cathode is advantageous both during the operation of the cell and at the end-of-life cycle of the cell. With the RuC cathode, there is a small volume ratio between the protective thin steel layer and the copper core; in particular, this corresponds to a high weight ratio between the copper core and the protective layer, which for example goes from 10000% for a 0.15 mm layer to 600% for a 2.5 mm thick layer. This enables the full recovery of the collector bar from the spent cathode block at the cell life end and the introduction of the full collector bar as such into the copper recycling system, without any need to prior separation of the protective layer from the copper core. The copper recycling industry can enter the spent collector bar directly into the copper refining process and 99% copper is obtained by means of pyrometallurgical, converter, and anode furnace refining. By additional electrochemical refining of the 99% copper, a copper purity of 99.99% is achieved. The possibility to effectively recover the copper from the spent collector bars reduces the total cost of ownership. Moreover, the initial amount of copper in the RuC cathode remains in the cell production loop over a long time, because the recycled copper value, only reduced by a small copper recycling metal loss, is reused at each cell life cycle end.

Ready-to-Use by Thermal Fit Compared to Massive Steel Cathode Collector Bars

The current collector bars of the RuC cathode can be assembled by thermal fit. Thermal fit means a way of simply inserting the current collector bars into a precisely machined cavity into the carbon block, that is sufficient to hold it in place without any intermediate holding material such as used in all traditional rodding steps. An electrical contact is made through the different thermal expansion behavior of the collector bar and the carbon cathode block during heat up from room temperature to operating temperature in the cell start-up phase. Traditional rodding, glue or ramming paste is advantageously avoided with the use of the copper bar surrounded by the thin protective steel layer as described. The current collector bar is simply inserted into the precision-machined graphite slot with an interference that is sufficient to hold it in place without any intermediate holding material such as used in all traditional rodding steps. The thin protective steel layer allows the thermal fit that makes the cathode ready to use without any further process or materials.

In traditional technology on cell start-up, the cathode collector bar has to be rodded by a cast iron process that is time consuming and involves safety hazards and technical risks for performance and integrity of the carbon cathode blocks. Also, the use of cast iron involves large contact areas between the bar and the carbon block due to the cast iron shrinkage at rodding time. Moreover, pouring of cast iron needs large gaps in between the current collector bars and cathode. All these disadvantages are advantageously obviated with the RuC cathode which however can be implemented in a less preferred way in contact with the carbonaceous cathode through a conductive layer of ramming paste, cast iron or glue.

The specific conductivity of copper is much higher compared to that of steel, cast iron, carbon pastes, graphite pastes and carbonaceous glues used inside cathode blocks.

At an operation temperature of 1000° C., the ratio of specific electrical conductivities for Cu to steel is from 8-15. For example, Cu is 10 times more conductive than steel. To achieve the same or an equivalent electrical resistance of a steel bar by a Cu bar of the same length, with Cu bars a 10 times less cross section and volume is needed.

As an example, a typical cross section of a conventional steel bar used inside cathodes is 122×122 $mm^2$ (14,884 $mm^2$). To replace this by a Cu bar (conductivity ratio 10) and have the same electrical resistance for the same bar length, a Cu bar with a cross section of 1,488 $mm^2$ would be enough, which means a Cu bar with 70 mm height and a thickness of 21.3 mm. The Cu bar height is only 57% of a steel bar and the Cu bar width is only 17% that of the steel bar.

The thermal expansion of the Cu bars from room temperature up to 1000° C. is 0.3-0.4 mm while a steel bar of 122 mm width would expand 1.4-1.5 mm, which means 4-5 times more. This expansion of more than 1 mm for steel bars, leads to enormous stress in the slot radius and leads to wing cracks. To prevent this with steel bars, initial air gaps must be provided at room temperature. The overlapping thermal expansion of a steel bar at operating temperature has to be typically on a level of 0.1-0.3 mm. This range is achieved with Cu bars by thermal expansion without any initial air gap or with a tight mechanical fit (i.e. initial air gap measured of the order of several μm) in the slot. A tight mechanical fit is good enough, and is advantageous to ensure a high contact pressure at operation temperature but at the same time not overstressing the wings of cathode materials. Lower wing height also supports this low stressing of cathode material.

Measurements of CVD (Cathode Voltage Drop) and cathodic resistance of the RuC cathode have shown and demonstrated a low contact resistance and low contact voltage, even with 30-50% of the contact area compared to steel bars.

With the inventive RuC cathode, by providing a very thin steel protective layer on the copper/copper alloy, the problem of differential thermal expansion is minimized. The problem of initial air gap and poor electrical contact is suppressed, and the contact pressure is assured at all time.

Cu Melting Temperature Decreases with Increased Alloying with Al and Si or Other Elements The inventive thin steel barrier will prevent the alloying of Cu with elements like Al and Si during operation in the electrolysis cell. This will prevent any melting that can happen without protection: Electrical conductivity, as well as the melting temperature of Cu (1083° C.), are lowered by alloying, as can be shown by a phase diagram.

Reduce Thick Protection to 1 Thin Layer

In conventional Cu bar designs, the Cu is protected solely by cast iron, but in most cases the Cu parts are protected by two thick layers. A first layer is cast iron coming from cast iron rodding with a typical thickness of 10-30 mm. A second layer is a thick steel layer around the Cu insert whose thickness depends on the shape and design and is typically in the range 10-200 mm. The overall thickness of the 2 layers is 20-200 mm.

With the new RuC solution the barrier is reduced to one thin layer of steel (advantageously with no cast iron), which is enough for the protection over the cell lifetime. For the RuC the thickness of the thin steel layer is reduced by 5-20 times less compared to conventional designs.

Example 1

A rectangular slot with 27 mm width and 105 mm depth was machined into conventional carbonaceous cathode feedstock blocks with dimensions 400×450×3300 $mm^3$ using a conventional end mill that was moved through the bottom face of the feedstock block. Two copper cathode collector bars steel clad according to the invention as indicated below, sized 27×85×1670 $mm^3$ (width×height×length), were inserted symmetrically into the formed slot of each block, leaving a gap of 150 mm in the middle of the block, which is filled with conventional refractory material. If required due to slight deformations of the collector bar, a mechanical or hydraulic press was used to push the collector bars into the slot. Different variants of steel clad were produced by cold rolling on rectangular copper bars: steel clad thicknesses of 1.0 mm, 1.7 mm, 2.0 mm, and 2.5 mm, with corresponding copper bar cross sections (width×height) of 25.0×83.0 $mm^2$, 23.6×81.6 $mm^2$, 23.0×81.0 $mm^2$, and 22.0×

80.0 $mm^2$, with approximate volume ratios copper to steel of 9.4, 5.2, 4.5, and 3.3. The collector bars are then connected at their outer ends through a steel block of larger cross-section which is then connected to the current source of the electrolysis cell.

Example 2

Copper cathode collector bars as in Example 1 were each coated with a layer of low carbon steel 2 mm thick. The cross section of the cathode collector bar, including a 2 mm thick layer of low carbon steel, applied by cold rolling, was 30×75×1670 $mm^3$ (width×height×length). The collector bar consists of a copper core with rectangular cross section of 26×71 $mm^2$ (width×height). The steel layer has on all four corners outside over the length of the rectangular shape a radius of 3.4 mm. A steel plate of 30×75 $mm^2$ (width×height) with a thickness of 3 mm was applied at the end of the cathode collector bar for connection to an external current supply. The tolerance of width of the cathode collector bars was +/−30 μm over the full length.

A rectangular slot with 30.07 mm width (+/−30 μm over the full length) and radius 4.0 mm and 105 mm depth was machined into a conventional carbonaceous cathode feedstock block with dimensions 400×450×3300 $mm^3$ using a conventional end mill that was moved through the bottom face of the feedstock block. An initial nominal air gap of 0.07 mm was applied in between the cathode collector bar and the machined slot. Two cathode collector bars according to the invention, sized 30×75×1670 $mm^3$ (width×height×length), were inserted symmetrically into the formed slot, leaving a gap of 150 mm in the middle of the block, which is filled with conventional refractory material. If required due to slight deformations of the collector bar, a mechanical or hydraulic press was used to push the collector bars into the slot.

The collector bars are then connected at their outer ends through a steel block of larger cross-section which is then connected to the current source of the electrolysis cell.

Example 3

A rectangular slot with 27 mm width and 105 mm depth was machined into a conventional carbonaceous cathode feedstock block with dimensions 400×450×3300 $mm^3$ using a conventional end mill that was moved through the bottom face of the feedstock block. Two cathode collector bars steel clad according to the invention as indicated below, sized 27×85×1670 $mm^3$ (width×height×length), were inserted symmetrically into the formed slot, leaving a gap of 150 mm in the middle of the block, which is filled with conventional refractory material. If required due to slight deformations of the collector bar, a mechanical or hydraulic press was used to push the collector bars into the slot. The collector bar consists of a copper core with rectangular cross section of 21.4×79.4 $mm^2$ (width×height) which is surrounded by a double layer of graphite foil having a thickness of 0.1 mm each. This intermediate is then covered with a 1.7 mm thick layer of low-carbon steel through cold rolling. Finally, the steel layer is coated with layers of nickel (0.4 mm thick) and chromium (0.4 mm thick), followed by another layer of graphite foil (0.1 mm thick), giving the aforementioned overall dimensions. The collector bars are then connected at their outer ends through a steel block of larger cross-section which is then connected to the current source of the electrolysis cell.

Testing

Figure 6:
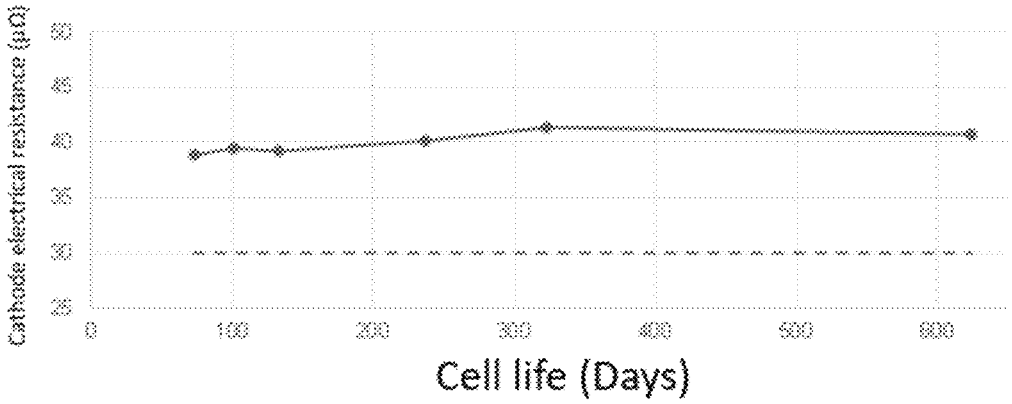
FIG. 6 is a graph of the voltage of a cathode with a protective layer according to the invention during an operational period of 20 months.

Aluminium production cells were fitted with the cathode blocks and cathode current collectors of Examples 1 and 2, without any rodding with cast iron or glue or ramming paste, and were subjected to long term testing for a period of at least 20 months. The cells were started with an electrical preheat using full current load of 11.0 kA per cathode (no shunts available). The average cathode current density was 0.83 A/cm2. During operation, the cells operated with an average current of 5.5 kA per copper bar on each side of the cathodes. The operating bath temperature was in the range of 955° C. to 975° C. To test the robustness of the copper bars at higher temperature, the cell was brought to 1100° C. for 10 hours. No impact of the high temperature could be observed at autopsy time. The cathodes were graphitized with a thermal conductivity close to 100 W/mK at 1000° C. The voltage was measured between the liquid metal and the end of the collector bar periodically together with the current. As shown in FIG. 6, the electrical resistance remained quasi constant over the 20 months period at close to 40μΩ.

Figure 7:
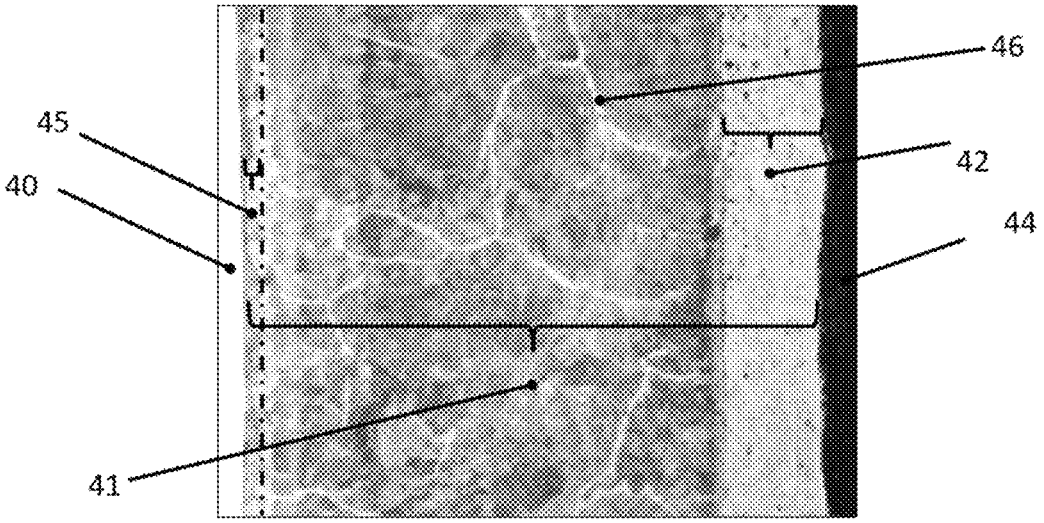
FIG. 7 is a microscope picture of a vertical section of a copper bar with a 2 mm protective steel layer, after operation in a Hall-Héroult cell for 18 months.

FIG. 7 is a microscope picture of a vertical section of a cut-away copper bar 40 with a 2.5 mm protective steel layer 41 (Example 1), showing steel intermetallic alloyed Aluminium 42 formed at the protective layer on the carbon cathode side 44 after operation in a Hall-Héroult cell for 18 months. The 100% pure copper 40 is protected and shows no Aluminium concentration after 18 months. The Aluminium layer 42 may vary depending on the carbon cathode grade. It is 400 microns thick in our example. On the copper core side, a layer 45 of 50 microns contains some copper diffused in the protective layer. The protective thin steel layer 41 shows a network of carbides 46.

Figure 8:
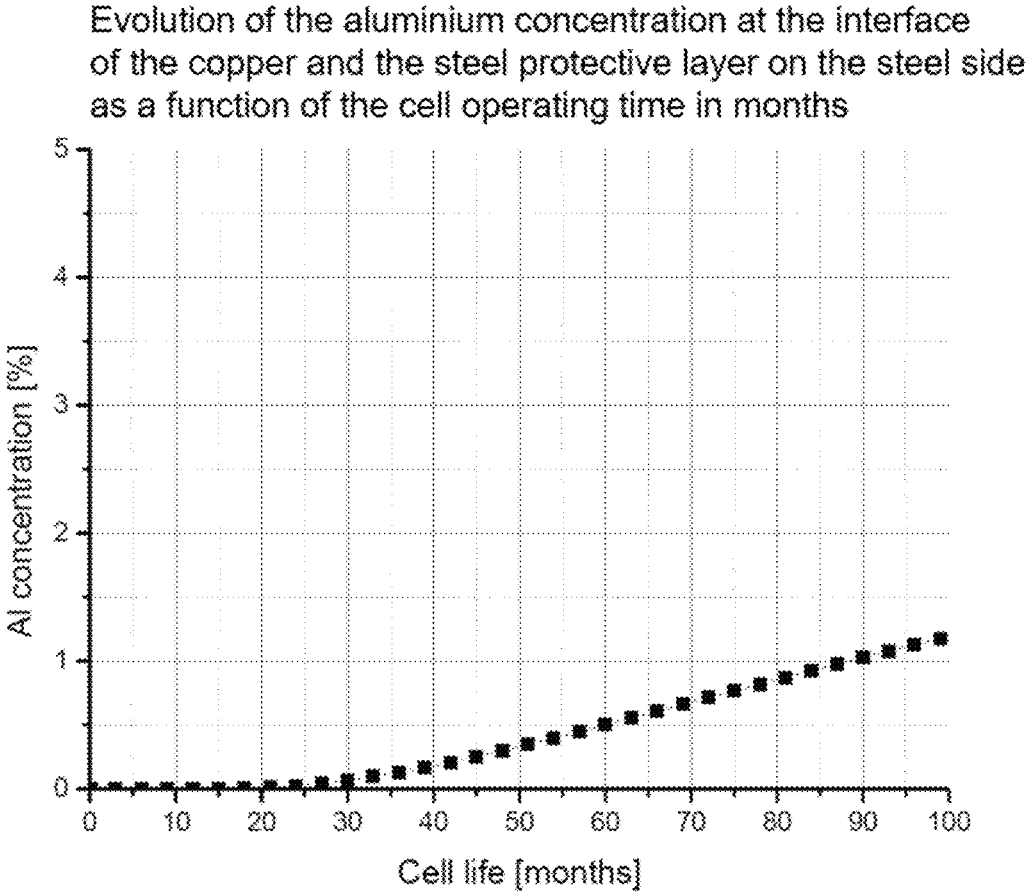
FIG. 8 is a graph of diffused Aluminium concentration at the interface of the copper and the steel protective layer on the steel side calculated as a function of the cell operating time in months, extrapolated to 100 months.

FIG. 8 is a graph of the calculated diffused Aluminium concentration at the interface of the copper and thin steel protective layer on the steel side, as a function of the cell operating time in months extrapolated to 100 months, for a cell according to the invention with a 2 mm thick steel layer clad on a copper core (Example 2). As can be seen from the curve, the diffusion of Aluminium is substantially reduced, namely the concentration of diffused Aluminum remains under 1.2% at the end over the extrapolated full cell lifetime.

Variations

The conditions of the above Examples can be varied as indicated below without compromising the performance in terms of the cell operating voltage, lifetime, and protection of the copper layer from unwanted alloying by aluminium.

Instead of being of rectangular cross-section, the copper collector bars can have a square cross-section or a round cross-section.

The thickness of the steel layer can be varied from 0.15 mm to 4 mm. Below a thickness of 0.15 mm the steel layer provides an insufficient protective effect. A steel layer thicker than 4 mm leads to an increase in operating potential and problems of recuperation of copper at the end of the cell lifetime. Within these extremes, the steel layer is preferably from 1.5 to 3 mm thick.

If an intermediate under or over layer of graphite and/or nickel and/or chromium and/or copper is applied its thickness is preferably from 1 μm to 1 mm and should normally be less than the thickness of the steel layer.

The gap between the facing ends of the collector bars can be varied notably as a function of the length of the copper collector bars to account for their thermal expansion at the cell operating temperature.

The invention claimed is:

1. An aluminium production cell comprising: an elongated cathode current collector bar in contact with a carbonaceous cathode, the elongated cathode current collector bar being made of highly electrically conductive copper or a copper alloy coated on its surface facing the cathode or all around with a protective steel layer that is more mechanically and chemically resistant than the copper or copper alloy, wherein the protective steel layer is thin and its thickness corresponds to a minimum thickness of the layer that is sufficient to form an effective diffusion barrier to protect the copper or copper alloy from diffusion of reaction products produced on the carbonaceous cathode during operation, wherein:

the volume ratio of the copper or copper alloy to the thin steel protective layer is at least 200%, the thin protective steel layer has a thickness of 0.15 mm up to 4 mm, and the thin protective steel is in direct or indirect contact with the carbonaceous cathode.

2. The cell according to claim 1, wherein the thin protective steel layer is made of carbon steel or alloy steel.

3. The cell according to claim 2, wherein the thin protective layer is made of low-carbon steel, chromium-based steel, nickel-based steel or chromium nickel based steel.

4. The cell according to claim 1, wherein the thickness of the thin steel protective layer is from 1.5 mm to 3 mm.

5. The cell according to claim 1, wherein the cathode collector bar has a cylindrical core of copper or copper alloy and the protective thin steel layer is a tube that is pressed against the copper or copper alloy core in such a way that the copper or copper alloy core is in full contact with the protective layer to achieve a homogeneous pressure of the cathode collector bar towards the carbon cathode once in operation.

6. The cell according to claim 1, wherein there is initially a gap between the copper or copper alloy and the protective thin steel layer, which gap is smaller than the thermal expansion of the copper or copper alloy core.

7. The cell according to claim 1, wherein the copper or copper alloy is in the form of a bar of rectangular cross-section that is protected on one side facing the cathode with the protective thin steel layer.

8. The cell according to claim 1, wherein the protective thin steel layer or an optional pre-applied thinner conductive non-ferrous under or overcoat on the protective steel layer is in direct contact with walls of a slot in the carbonaceous cathode.

9. The cell according to claim 8, wherein the protective thin steel layer is coated with an additional top layer and/or under layer of copper, nickel and/or chromium and/or a graphite paint or foil layer.

10. The cell according to claim 9, wherein the additional top layer and/or underlayer has a thickness of from 1 μm to 1 mm.

11. The cell according to claim 1, wherein the protective thin steel layer optionally including a pre-applied thinner conductive non-ferrous under or overcoat is in contact with the carbonaceous cathode through a conductive layer of ramming paste, cast iron or glue.

12. The cell according to claim 1, wherein the copper or copper alloy is in the form of a rectangular bar, wherein the protective thin steel layer is coated on all sides of the rectangular bar or on one side of the rectangular bar and, from adjacent to the coated side, at least partly along the two other sides of the rectangular bar.

13. A cathode current collector assembly for an aluminium production cell, comprising: an elongated cathode current collector bar in contact with a carbonaceous cathode, the elongated cathode current collector bar being made of highly electrically conductive copper or a copper alloy coated on its surface facing the cathode or all around with a protective steel layer that is more mechanically and chemically resistant than the copper or copper alloy, wherein the protective steel layer is thin and its thickness corresponds to a minimum thickness of the layer that is sufficient to form an effective diffusion barrier to protect the copper or copper alloy from diffusion of reaction products produced on the carbonaceous cathode during operation, wherein:

the volume ratio of the copper or copper alloy to the thin steel protective layer is at least 200%, the thin protective steel layer has a thickness of 0.15 mm up to 4 mm, and the thin protective steel is in direct or indirect contact with the carbonaceous cathode.

* * * * *